US009941634B1

(12) United States Patent
Werhan

(10) Patent No.: US 9,941,634 B1
(45) Date of Patent: Apr. 10, 2018

(54) SAFETY HOOK SYSTEM TO PREVENT PREMATURE SEPARATION OF CONNECTED DEVICE

(71) Applicant: Robert Dominic Werhan, Lake Elsinore, CA (US)

(72) Inventor: Robert Dominic Werhan, Lake Elsinore, CA (US)

( * ) Notice: Subject to any disclaimer, the term of this patent is extended or adjusted under 35 U.S.C. 154(b) by 0 days.

(21) Appl. No.: 15/242,899

(22) Filed: Aug. 22, 2016

Related U.S. Application Data

(60) Provisional application No. 62/208,739, filed on Aug. 23, 2015.

(51) Int. Cl.

| | |
|---|---|
| ***H01R 13/639*** | (2006.01) |
| ***H01R 24/28*** | (2011.01) |
| ***H01R 24/58*** | (2011.01) |
| *H01R 105/00* | (2006.01) |

(52) U.S. Cl.
CPC ..... *H01R 13/639* (2013.01); *H01R 24/28* (2013.01); *H01R 24/58* (2013.01); *H01R 2105/00* (2013.01); *Y10T 24/318* (2015.01); *Y10T 24/4755* (2015.01)

(58) Field of Classification Search
CPC ..... H01R 13/639; H01R 24/28; H01R 24/58; H01R 2105/00; Y10T 24/314; Y10T 24/316; Y10T 24/318; Y10T 24/4755
See application file for complete search history.

(56) References Cited

U.S. PATENT DOCUMENTS

| | | | | |
|---|---|---|---|---|
| 5,462,019 | A * | 10/1995 | Hong-Rong | A01K 1/04 119/795 |
| 2005/0039310 | A1* | 2/2005 | Borne | H02G 11/00 24/300 |
| 2007/0145087 | A1* | 6/2007 | Mikesell | B25H 3/006 224/269 |
| 2013/0067697 | A1* | 3/2013 | Huang | A63B 21/0555 24/301 |

* cited by examiner

*Primary Examiner* — Robert J Sandy
(74) *Attorney, Agent, or Firm* — Plager Schack LLP

(57) ABSTRACT

Some embodiments of the present disclosure include a safety hook attachment for preventing the premature disconnect of a device from a cord. The safety hook attachment may include a fastening body configured to attach to the cord; a tail extending from the fastening body; and a connector attached to an end of the tail distal from the fastening body, wherein the connector may be configured to attach to the device to be connected to the cord.

7 Claims, 4 Drawing Sheets

SAFETY HOOK SYSTEM TO PREVENT PREMATURE SEPARATION OF CONNECTED DEVICE

RELATED APPLICATION

This application claims priority to provisional patent application U.S. Ser. No. 62/208,739 filed on Aug. 23, 2015, the entire contents of which is herein incorporated by reference.

BACKGROUND

The embodiments herein relate generally to connectors, and more particularly, to a safety hook system to prevent premature separation of connected devices.

Often times a cord, hose, or the like can become easily disconnected from a desired device prematurely. At times, this could create great frustration for a user. For example, in the case of a laptop, its power cord may come accidently disconnected. When the laptop's battery is charged, it may not matter. However, if the battery is not charged or does not hold a charge, this could result in the device turning off.

Therefore, what is needed is a hook system to prevent the premature or accidental disconnection of a device from a connector, such as a cord, hose, or the like.

SUMMARY

Some embodiments of the present disclosure include a safety hook attachment for preventing the premature disconnect of a device from a cord. The safety hook attachment may include a fastening body configured to attach to the cord; a tail extending from the fastening body; and a connector attached to an end of the tail distal from the fastening body, wherein the connector may be configured to attach to the device to be connected to the cord.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to prevent the premature separation of connected devices and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Hook Connector
2. Fastening Body
3. Tail

The various elements of the device of the present disclosure may be related in the following exemplary fashion. It is not intended to limit the scope or nature of the relationships between the various elements and the following examples are presented as illustrative examples only.

Figure 1:
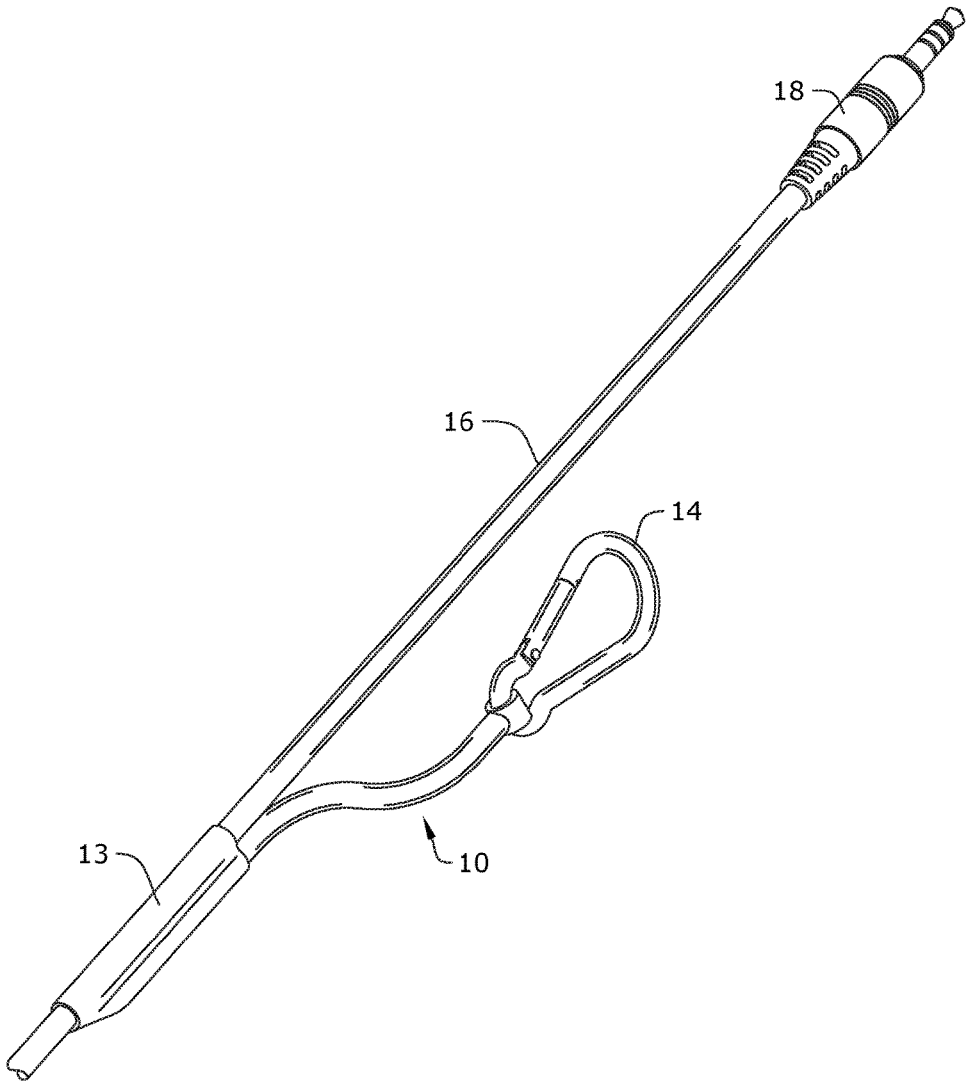
FIG. 1 is a perspective view of one embodiment of the present disclosure.
Figure 2:
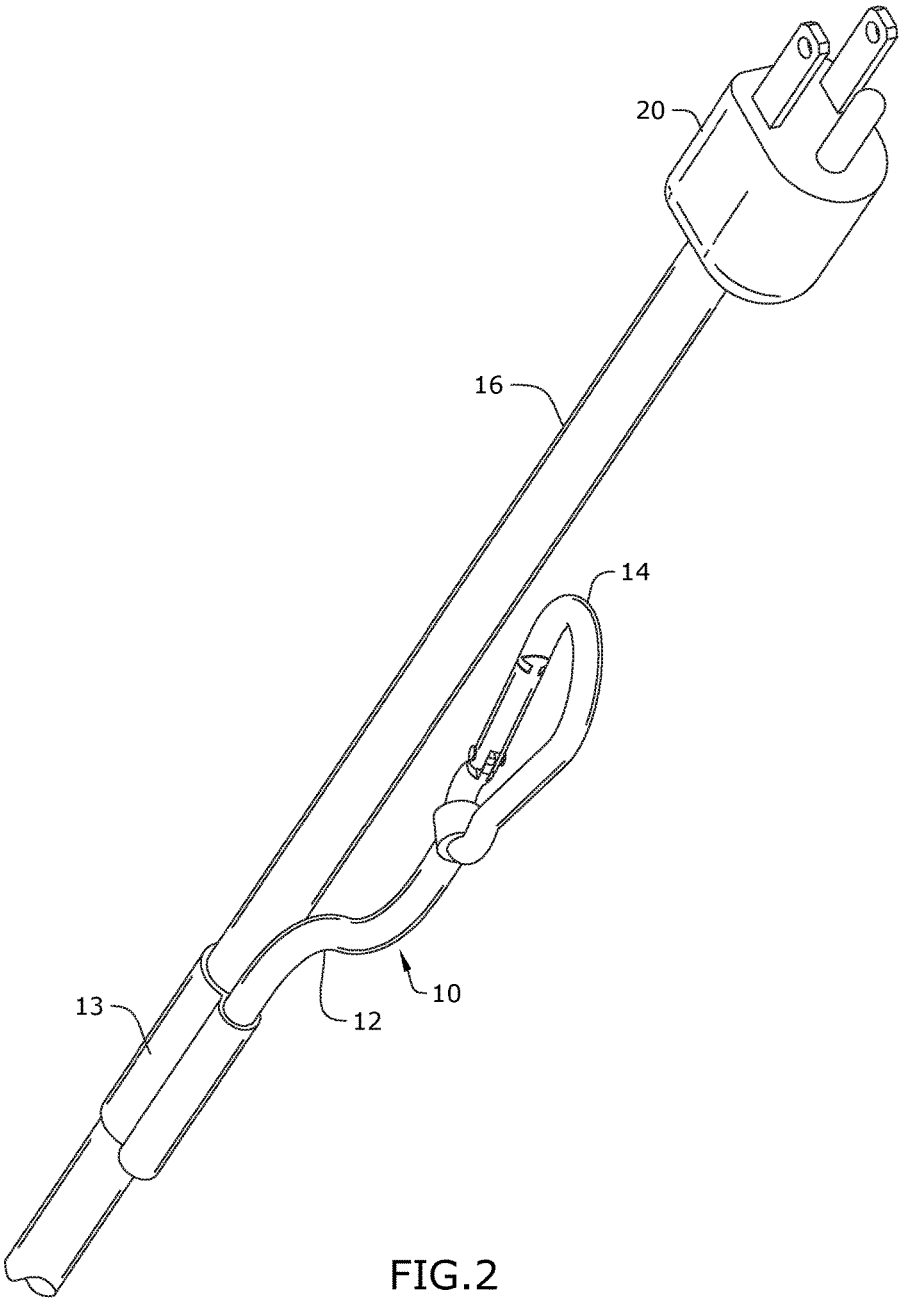
FIG. 2 is a perspective view of one embodiment of the present disclosure.
Figure 3:
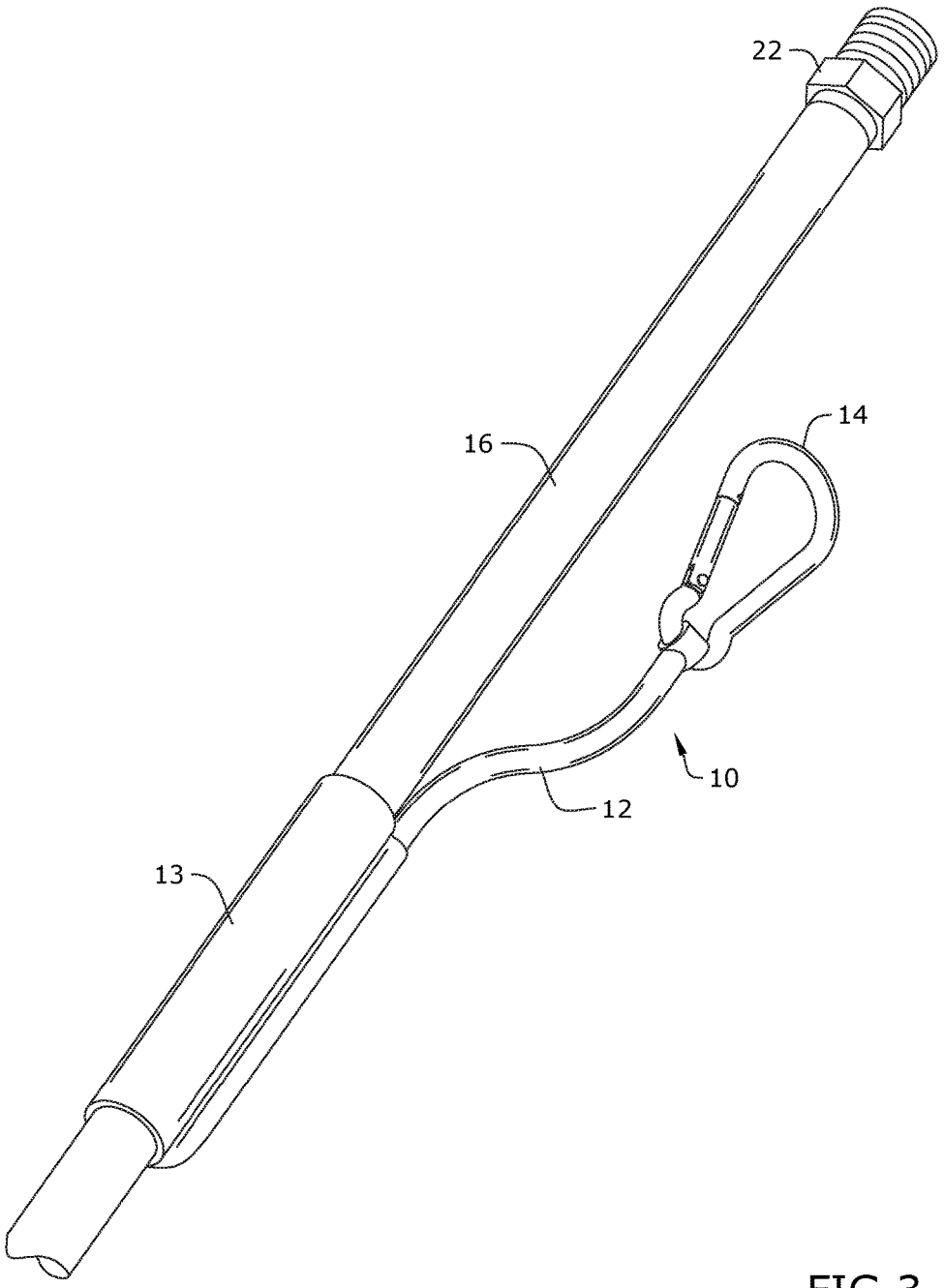
FIG. 3 is a perspective view of one embodiment of the present disclosure.
Figure 4:
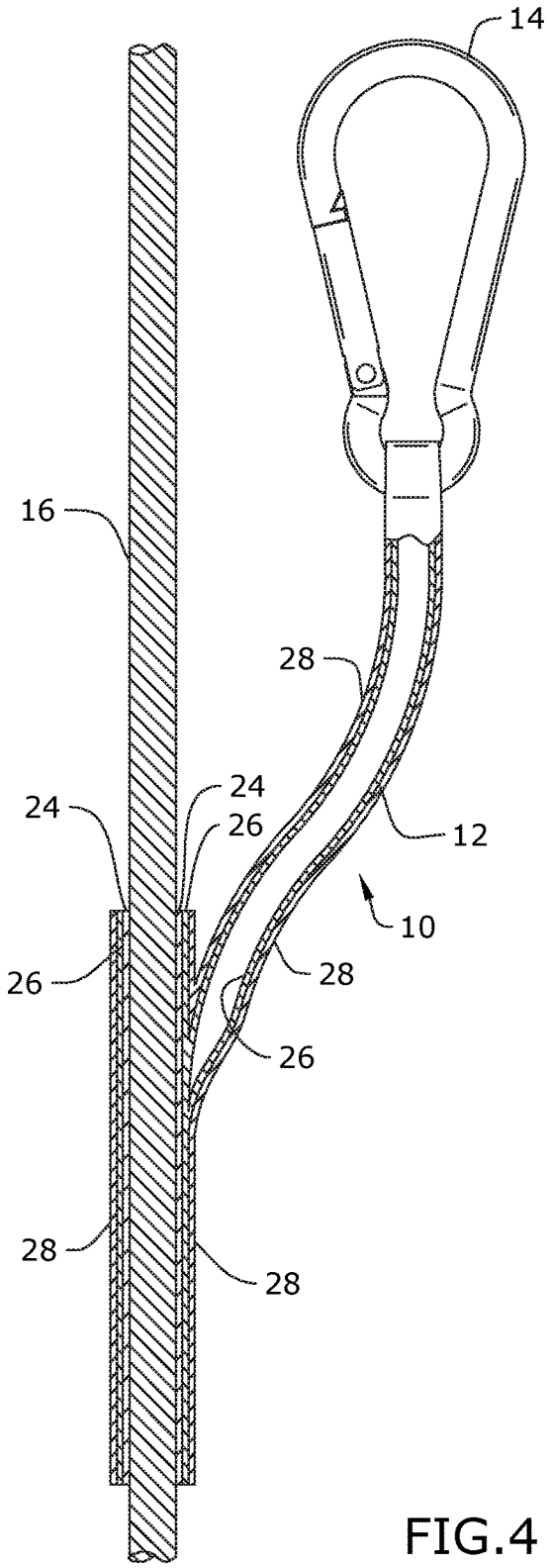
FIG. 4 is a section detail view of one embodiment of the present disclosure, taken along line 4-4 in FIG. 1.

By way of example, and referring to FIGS. 1-4, some embodiments of the present disclosure include a safety hook attachment 10 for preventing the premature or accidental disconnect of a device (not shown) from a cord 16, tube, hose 22, wire, or the like, the safety hook attachment 10 comprising a fastening body 13 attached to the cord 16; a tail 12 extending from the fastening body 13; and a connector 14 attached to an end of the tail 12 distal from the fastening body 13, wherein the connector is configured to engage with or attach to the device to be connected. As shown in the Figures, the fastening body 13 may comprise a layered construction. The layered construction may comprise an inner protectant layer 24 configured to encircle the cord 16; a middle braided layer 26; and an outer covering layer 28 configured to cover the exposed braided layer 26 for safety and durability.

The device of the present disclosure may be made of any suitable materials. In some embodiments, the inner protectant layer 24 may comprise a material selected from the group consisting of shrink wrap and tape. The braided layer 26 may comprise a braided material such as stainless steel wire or nylon thread, which may be applied to the cord 16 over the inner protectant layer 24 using, for example, a multi-carriage braiding machine. The outer layer 28 may comprise any desired or suitable outer covering layer. The connector 14 may comprise any sort of hooking or fastening device, such as a carabineer or a conventional hook.

The device of the present disclose may have any desired size, and in some embodiments, the tail 12 may have a length of from about 4 to about 12 inches.

In some embodiments, the device of the present disclosure may be built into the cord 16 during manufacture. However, in other embodiments, the device may comprise an attachment that may be removed from one cord 16 and used on a second cord.

To use the device of the present disclosure, a user may attach the fastening body 13 to the cord 16 that is going to be connected to the device. The fastening body 13 may be attached such that the length of the tail 12 is less than the length of the cord 16 between the fastening body 13 and the jack 18, plug 20, hose 22, or the like. The user may engage the cord 16 with the device as normal and also attach the connector 14 to the device. This may result in the cord 16 being securely attached until the user no longer desires it to be attached to the device. The device of the present disclosure may help prevent premature disconnection of the cord 16.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A safety hook attachment for preventing the premature disconnect of a device from a cord, the safety hook attachment comprising:

a fastening body configured to attach to the cord;

a tail extending from the fastening body; and a connector attached to an end of the tail distal from the fastening body, wherein:

the connector is configured to attach to the device to be connected to the cord; and the fastening body is attached to the cord at a position such that a distance between the fastening body and an end of the cord configured to engage with the device is longer than a length of the tail.

2. The safety hook attachment of claim 1, wherein the fastening body comprises a layered construction.

3. The safety hook attachment of claim 2, wherein the layered construction comprises:

an inner protectant layer configured to encircle the cord;

a middle braided layer; and an outer covering layer.

4. The safety hook attachment of claim 3, wherein the inner protectant layer comprises a member selected from the group consisting of shrink wrap and tape.

5. The safety hook attachment of claim 3, wherein the middle braided layer comprises a member selected from the group consisting of stainless steel wire and nylon thread.

6. The safety hook attachment of claim 1, wherein the length of the tail is from about 4 to about 12 inches.

7. The safety hook attachment of claim 1, wherein the connector is a member selected from the group consisting of a carabineer and a hook.

* * * * *